United States Patent [19]

Cavallo

[11] Patent Number: 4,651,614

[45] Date of Patent: Mar. 24, 1987

[54] GUITAR PICK

[76] Inventor: Robert S. Cavallo, 4840 La Montana Cir., Tarzana, Calif. 91356

[21] Appl. No.: 679,485

[22] Filed: Dec. 7, 1984

[51] Int. Cl.[4] ..... G10D 3/16

[52] U.S. Cl. ..... 84/322

[58] Field of Search ..... 84/322

[56] References Cited

U.S. PATENT DOCUMENTS

| | | | |
|---|---|---|---|
| 2,221,234 | 11/1940 | Frasier | 84/322 |
| 3,312,137 | 4/1967 | Oddo | 84/322 |
| 4,226,160 | 10/1980 | Picciochi | 84/322 |
| 4,228,719 | 10/1980 | Keene | 84/322 |
| 4,395,932 | 8/1983 | Mills | 84/322 |
| 4,398,444 | 8/1983 | Walker | 84/322 |

*Primary Examiner*—Lawrence R. Franklin

*Attorney, Agent, or Firm*—Rapkin, Gitlin & Moser

[57] ABSTRACT

A single or unitary piece of resilient molded plastic having a pair of pick blades that individually taper at one end and converge at the opposite end to form a common grip or handle. The blades are situated in parallel relation to each other and one blade is slightly offset from the other.

3 Claims, 2 Drawing Figures

GUITAR PICK

BACKGROUND OF THE INVENTION

1. Field of the Invention

The present invention relates generally to the field of musical instruments and more particularly to a device for use in playing a stringed musical instrument, such as a guitar or banjo.

2. Description of the Prior Art

In order to produce sound from a musical instrument, such as a guitar or banjo, the strings are plucked by either the thumb, finger or a device commonly known as a pick. Some musicians prefer the use of the pick because it produces a better quality tone. Other people prefer the pick because it provides improved control over the strings of the instrument than the fingers or thumb do.

The prior art includes picks that vary widely in structure and design in order that they might produce different musical sounds. The differences in the sounds produced purportedly are due to a number of factors, including the resiliency of the material used to construct the pick, the design of the pick and the use of spacer elements that separate the pick blades. Tonal qualities produced by a stringed instrument will vary depending upon the manner in which the pick is held between the thumb and index finger when the strings are plucked and whether or not a spacer element is utilized and, if so, the material composition of the element. Multiple picks formed as one are also capable of producing unique sounds from the instrument that would otherwise be extremely difficult or even impossible to create with only a single pick.

Curiously, none of the picks in the prior art appears to include a grip or handle that would aid the musician in maximizing the tonal qualitites of the sound produced by the stringed instrument. Emphasis always seems to be placed on the design or the number of the picks utilized, while the handle or grip is all but ignored as a means to improve the musical sounds produced by the instrument. The present invention seeks to improve the prior art by providing an inexpensive and easy to use pick having two blades formed together and joined by a single tapered handle. The handle is designed to more easily accommodate the grasp of the thumb and index finger to provide improved control over the plucking and strumming of the strings in order to maximize the varieties of the tones and sounds that are capable of being produced by the instrument. Applicant knows of no other device in the prior art that combines these elements.

The advantages and distinctions of the present invention over the prior art will become clearly evident in the following disclosure.

SUMMARY OF THE INVENTION

The present invention in its preferred embodiment comprises a single or unitary piece of resilient molded plastic having a pair of pick blades that individually taper at one end and converge at the opposite end to form a common grip or handle that will accommodate the shape of the fingers to maximize control over the pick. The blades are situated in parallel relation to each other and one blade is slightly offset from the other.

The primary object of the present invention is to provide a pick with a specially formed grip that accommodates the shape of the fingers and enhances the musician's control over the manner in which the strings are plucked and strummed and the quality and varieties of sounds that are produced by the instrument.

Another object of the present invention is to provide a pick that can be used to selectively produce single or multiple tones from the strings as they are struck by the pick.

Another object of the present invention is to provide a pick that can be more easily controlled by the musician to produce a variety of tones as the strings are struck by the pick.

Still another object of the present invention is to provide a pick that is convenient to use and inexpensive to manufacture.

Still another object of the present invention is to provide a pick with multiple pick blades that do not require a spacer element affixed therebetween.

Other objects and advantages will become apparent in the following specifications when considered in light of the attached drawings wherein a preferred embodiment of the invention is illustrated.

A BRIEF DESCRIPTION OF THE DRAWINGS

DETAILED DESCRIPTION OF THE PREFERRED EMBODIMENTS

Figure 1:
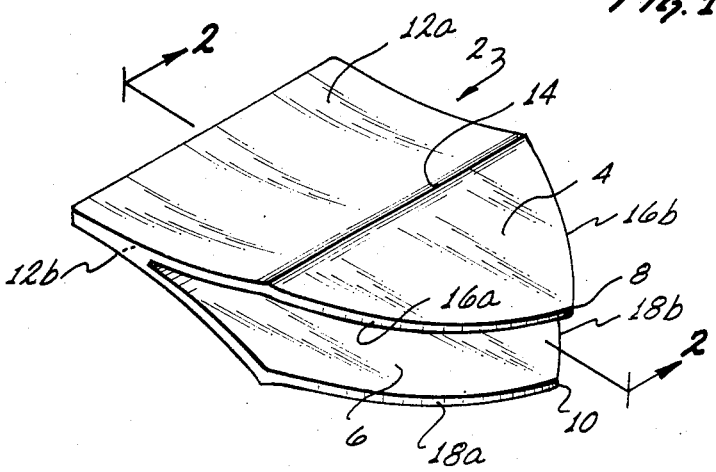
FIG. 1 is a top plan view of the preferred embodiment of the present invention.
Figure 2:
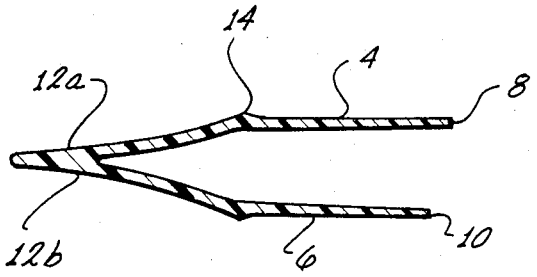
FIG. 2 is a section taken along line 2—2 of FIG. 1.

Referring now in greater detail to the pick of the present invention, and with particular reference to the embodiment illustrated in the drawings, pick 2, which is usually formed of a resilient plastic, is shown having a pair of blades consisting of an upper blade 4 and a lower blade 6, which are formed in spaced parallel relation to one another. Upper blade 4 terminates at picking end 8 and lower blade 6 terminates at picking end 10. Blades 4 and 6 are offset relative to one another by approximately 5/16 inch, although this distance may vary depending upon the particular requirements of the musician. Picking end 10 terminates short of picking end 8, see FIG. 2. Blade 4 and blade 6 have picking edges **16*a*, 16*b* and 18*a*, 18*b*, respectively. Blades 4 and 6 have the approximate thickness and each are in the approximate shape of a conventional pick blade. Blades 4 and 6 begin to converge at their rearwardmost points or junction 14 to form a grip 12, having sides 12*a* and 12*b*, which the musician grasps, usually with his thumb and index finger, when using the pick 2 to play a stringed musical instrument. As shown in FIGS. 1 and 2, the gripping surfaces 12*a* and 12*b*** are concave to more easily accommodate the thumb and index finger. This enhances the player's control of the squeezing, bending and plucking movements of the pick blades.

It will be apparent that to utilize and maximize the most unique aspects of the present invention, the musician takes hold of grip 12 with his thumb and index finger and positions pick 2 adjacent to the strings to be picked. By compressing grip 12 at or near juncture 14, the user can vary the distance between picking ends 8 and 10 and picking edges **16*a*, 16*b* and 18*a*, 18*b*, thus varying the time intervals between the picking of the individual strings. For example, by applying a greater compressive force to grip side 12*b*, the musician shortens the offset distance between blades 4 and 6 and thus produces a different tonal quality or musical effect when the strings are picked. Moreover, varying the contact between the fingers and grip sides 12*a* and 12*b*** will produce different tonal qualities. Equal compression upon sides 12*a* and 12*b* to close the distance between blades 4 and 6 will, when multiple strings are picked simultaneously, produce a greater tremelo effect than would otherwise have resulted.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

I claim:

1. A pick for playing a stringed musical instrument, comprising:

a single piece of resilient material;

said piece including a pair of pick blades, each of said blades comprising a string engaging, tapered end portion with one of the pick blades terminating short of the other; and concaved, converging and oppositely disposed, contoured finger engaging surfaces, respectively, formed and extending rearwardly from each of said pick blades and joined at their ends, whereby said pick may be employed to enhance the player's control of the squeezing, bending and plucking movements of the pick blades and to increase sensitivity and the communication of music related information between the playing fingers and the guitar strings.

2. The invention of claim 4 wherein said pick is constructed of plastic.

3. The invention of claim 4 wherein said pick is constructed of a metal alloy.

* * * * *